United States Patent [19]

Morse et al.

[11] 4,041,728

[45] Aug. 16, 1977

[54] SUCTION ACCUMULATOR

[75] Inventors: Robert L. Morse, Adrian, Mich.; Sharon J. Hudson, Jr., Toledo, Ohio

[73] Assignees: Tecumseh Products Company, Tecumseh, Mich.; Sharon Manufacturing Company, Toledo, Ohio

[21] Appl. No.: 597,584

[22] Filed: July 21, 1975

[51] Int. Cl.[2] ..... F25B 43/00

[52] U.S. Cl. ..... 62/503

[58] Field of Search ..... 62/471, 503, 512, 115, 62/183, 278, 126

[56] References Cited

U.S. PATENT DOCUMENTS

| | | | |
|---|---|---|---|
| 2,010,547 | 8/1935 | Kenney et al. | 62/126 |
| 2,501,518 | 3/1950 | Horton et al. | 62/183 |
| 2,698,522 | 1/1955 | LaPorte | 62/503 X |
| 2,813,404 | 11/1957 | Hirsch | 62/115 |
| 3,021,693 | 2/1962 | Aune | 62/278 |
| 3,092,978 | 6/1963 | Jorentzen | 62/503 X |
| 3,163,998 | 1/1965 | Wile et al. | 62/278 |
| 3,232,073 | 2/1966 | Jobes et al. | 62/471 |
| 3,304,697 | 2/1967 | Ramsey | 62/471 X |
| 3,635,040 | 1/1972 | Morris, Jr. | 62/512 X |
| 3,796,064 | 3/1974 | Ladusaw | 62/503 |
| 3,837,177 | 9/1974 | Rockwell et al. | 62/503 |

FOREIGN PATENT DOCUMENTS

| | | |
|---|---|---|
| 554,807 | 7/1943 | United Kingdom |

*Primary Examiner*—Ronald C. Capossela

*Attorney, Agent, or Firm*—Barnes, Kisselle, Raisch & Choate

[57] ABSTRACT

A suction accumulator for use in a refrigerant compressing - evaporating system to accumulate in a reservoir the liquid phase of an incoming refrigerant fluid flowing into the accumulator and to control the return of the liquid to the gaseous refrigerant stream flowing out of the accumulator. A weir member located between an inlet and outlet of the accumulator vessel is utilized in conjunction with the vessel wall to form an outlet passageway or flume on one side of the weir end and a reservoir on the other side of the weir.

11 Claims, 11 Drawing Figures

SUCTION ACCUMULATOR

This application is related to concurrently filed patent applications in the name of Sharon J. Hudson, Jr., Ser. No. 597,585, filed July 21, 1975, entitled "Suction Accumulator" and assigned to Sharon Manufacturing Company (the Assignment being recorded at Reel 3216, Frame 692), and in the name of Robert L. Morse, Ser. No. 597,583, filed July 21, 1975, entitled "Suction Accumulator" and assigned to Tecumseh Products Company (the Assignment being recorded at Reel 3216, Frames 693-694), as sole inventors using copies of the specification and drawings of this application.

SUMMARY OF THE INVENTION

Generally speaking the invention relates to a liquid retention device for use in a refrigerant compressing—evaporating system. More particularly the invention relates to an improved suction accumulator which separates the liquid components from the gaseous components of an incoming stream of refrigerant fluid and temporarily retains the liquid so as to prevent an excessive amount of the liquid refrigerant components from being returned to the compressor or at least greatly reduce the probability of such an occurrence. It also controls the relative rate of outflow of the liquid lubricant component of the refrigerant fluid. This invention is especially useful in air conditioning systems that may be selectively operated in reverse on a defrost cycle or as a heat pump.

Basically the suction accumulator comprises a pressure type vessel with a vertically disposed partition or weir member having a shape such that when the edges of the weir member are sealingly attached to the interior wall surface of the vessel the weir member forms an outlet channel or flume section with the vessel wall surface confronting one of its sides. On the opposite side of the weir member a relatively large volume reservoir section is formed by this opposite side and its confronting vessel surface. A fluid inlet to the vessel is located on the reservoir side of the weir member and a fluid outlet from the vessel is located on the flume side of the weir member. The primary communication opening from the reservoir into the flume section is over the top of the weir member. A small liquid metering or bleed-through opening between the reservoir and flume sections is provided at the bottom of the weir member. Preferably an apertured baffle plate extends horizontally across the top of the reservoir above the inner end of the inlet tube which tube may also preferably be horizontally disposed and positioned generally tangentially with respect to a confronting cylindrical wall section of the accumulator vessel.

A suction accumulator constructed in accordance with the teachings of this invention is economical to produce, effective and easily adapted to special requirements of various refrigerant compressing—evaporating systems particularly those in which pressure drop must be reduced to a minimum. The structural design provides numerous additional advantages including ease of assembly, positive positioning of the component parts relative to one another and suitability for bonding the component parts together in a single pass through a brazing furnace. A further advantage of the structural design and arrangement of the component parts is that the accumulator has a high ratio of liquid retention capacity to total vessel volume. The preferred embodiment also provides superior liquid retention under unstable conditions e.g. under sudden pressure changes in the system occurring during system reversals. These advantages and other advantages will become apparent when the description is read with reference to the following drawings.

DETAILED DESCRIPTION OF THE INVENTION

Figure 4:
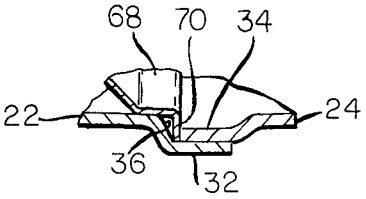
FIG. 4 is an enlarged cross sectional view of the common seal joint between the two vessel sections and the edges of the weir member.
Figure 2:
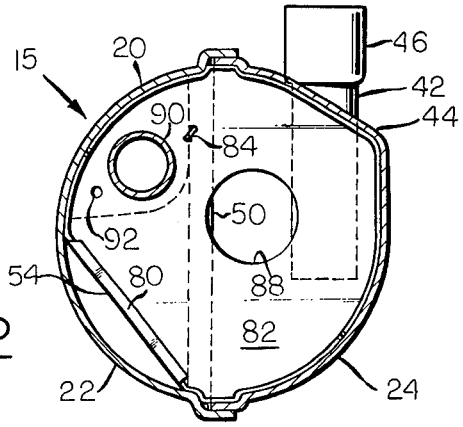
FIG. 2 is a sectional plan view taken along lines 2—2 of FIG. 1.
Figure 3:
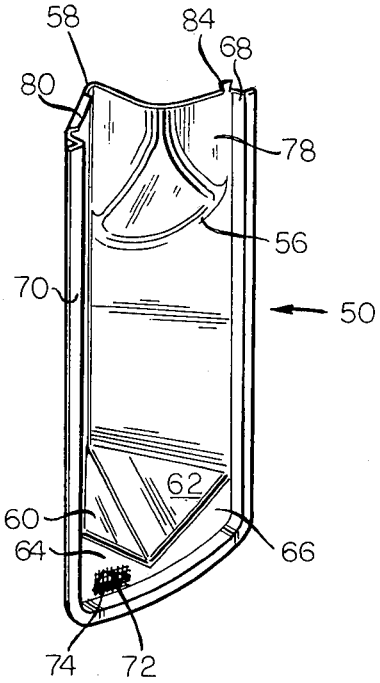
FIG. 3 is a perspective view showing the configuration of the internal weir member.
Figure 1:
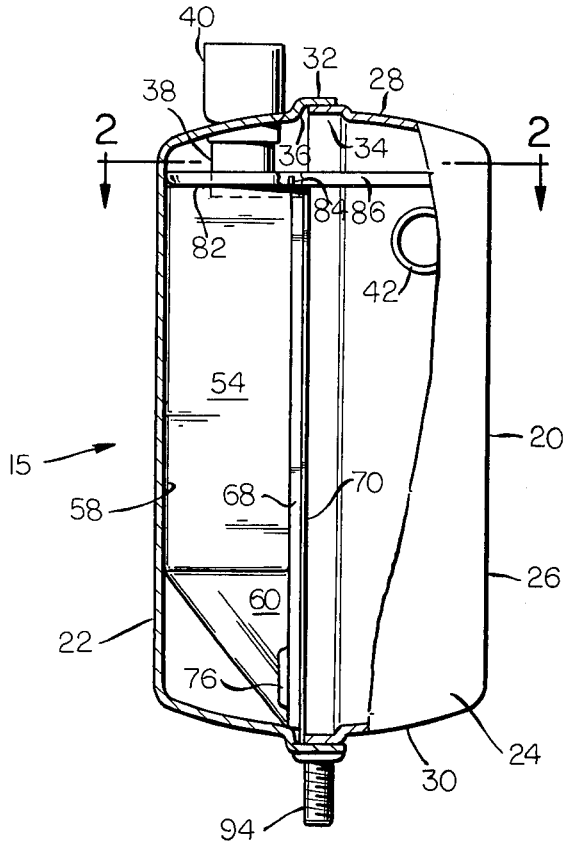
FIG. 1 is an elevation view of a preferred embodiment of the suction accumulator with outer parts broken away to show interior details.
Figure 5:
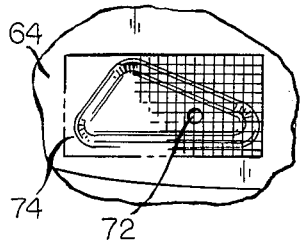
FIG. 5 is an enlarged view of an area of the lower end of the weir member containing the screened metering aperture.
Figure 8:
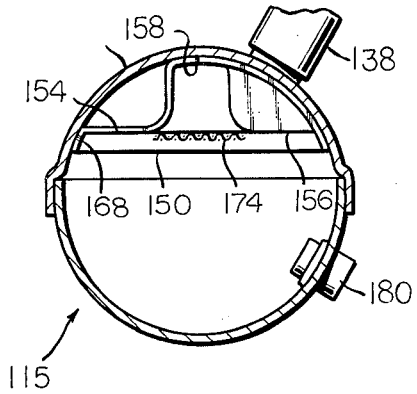
FIG. 8 is a sectional plan view taken along lines 8—8 of FIG. 6.
Figure 7:
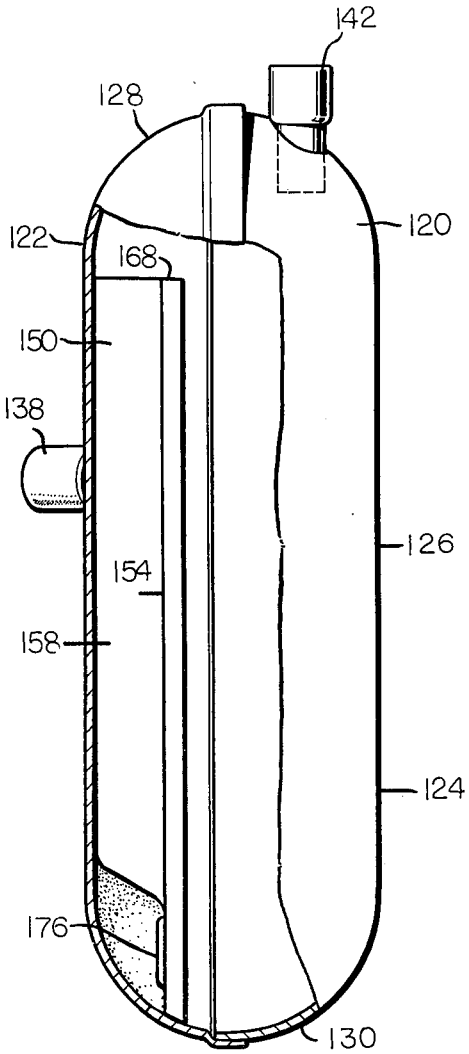
FIG. 7 is an elevation view similar to that of FIG. 6 but rotated 90° to the right about its vertical axis.
Figure 6:
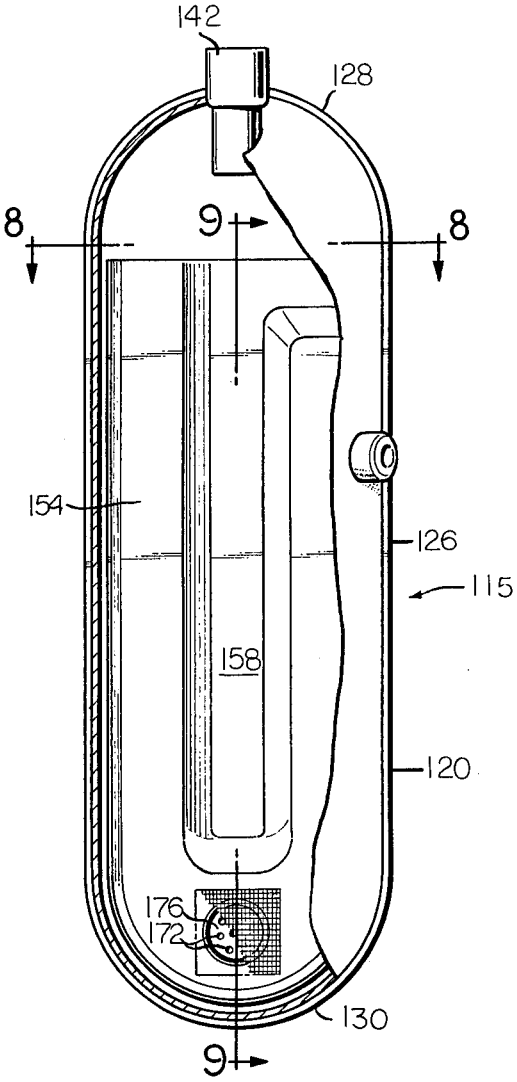
FIG. 6 is an elevation view of another embodiment of the suction accumulator with a portion of its vessel shell broken away to show interior details.

Each of the accumulator embodiments illustrated in the drawings has a vessel that is designed to withstand the pressure differentials anticipated during operation of the refrigerant—evaporating system in which it is incorporated. The accumulator vessels differ from each other in size and shape depending upon space limitations, refrigerant capacities and other factors associated with the system in which they are used. Preferably the accumulator vessels have a generally cylindrical midsection or body with rounded top and bottom ends. However, different shaped vessels including those having generally rectangular bodies and planar ends may be used but usually require stronger materials or reinforcing. The vessels disclosed herein are designed to be installed in their respective systems so that their greatest dimension is vertically oriented.

Suction accumulator 15 shown in FIGS. 1-4 has a pressure vessel 20 formed of two substantially symmetrical half sections 22, 24 produced from sheet metal by stamping processes. The half sections when joined together form a vessel that has a vertically disposed generally cylindrical midsection 26 with convex top 28 and bottom 30 ends. Preferably the half sections 22, 24 are joined together by overlapping seam means produced by lapping the marginal edge 32 of one of half section 22 over the marginal edge 34 of the other half section 24 FIGS. 2 and 4 and then securing the overlapping marginal edges 32, 34 together or by copper brazing in a hydrogen atmosphere furnace, thereby creating a strong fluid tight seam. One marginal edge 32 may be offset laterally outward to provide an internal ledge 36. In this embodiment both marginal edges 32, 34 are laterally offset. It is to be noted that in all embodiments the seam extends lengthwise of the vessel and preferably lies in a plane containing the longitudinal axis of the vessel which axis is vertically disposed when the vessel is installed. Conceivably the vessel could be formed with a laterally extending seam or of more than two basic parts but such alternatives presently appear to be inconvenient and impractical. A vertically disposed outlet pipe fitting 38 having its axis parallel with the cylindrical axis of the vessel is sealed in an extrusion-pierced, collared aperture in the top portion of vessel half section 22. The outer end 40 of the outlet fitting 38 is enlarged to form the female member of a sweat-type connecting means for receiving the outer end of a suction line of a mechanical compressor. The inlet pipe fitting 42 is contained in an extrusion-pierced, collared aperture extending through a bulbous or nose portion 44 formed in the cylindrical wall of vessel half section 24 adjacent its top end. Inlet fitting 42 is horizontally disposed and tangentially positioned with respect to the cylindrical surface of half section 24 so that incoming fluid will be introduced to a cylindrical surface and caused to flow around the vessel axis and passed the flat surfaces of a weir member 50 contained in the opposite half section 22. The inner end of the inlet fitting 42 is cut at a right angle to the fitting axis. The outer end 46 of inlet fitting 42 is enlarged to form the female member of a sweat type connecting means for the compressor return line from the refrigerant evaporator.

The weir members of the various embodiments are non-planar sheet metal plates formed by stamping processes. Each of them is formed so that when it is positioned vertically inside the vessel with its bottom and side edges sealingly attached to the inner surface of the vessel an outlet passageway or flume is formed on one side of the weir member and a fluid reservoir is formed on the other side thereof. The vertically disposed weir member 50 of the preferred embodiment shown in FIGS. 1-5 is wholly contained in vessel half section 22 and is shaped so that a generally U-shaped outlet flume having two upright legs with a connecting leg at their bottom ends is formed conjointly by the weir member and the confronting wall of vessel half section 22. The upper portion of the weir member 50 defines the upright legs of the outlet flume by means of two generally planar rectangular panel sections 54, 56 integrally connected together along a vertical fold or ridge 58 that abuts the vessel wall FIGS. 1, 2 and 3. These panel sections 54, 56 terminate above the bottom end of the vessel but have integrally connected triangular panel extensions 60, 62 that are angled away from the vessel wall FIG. 1 and integrally joined together in the shape of a half pyramid FIG. 3. Two coplanar wing sections 64, 66 FIG. 3 depending from the panel extensions 60, 62 span the spaces between the lower ends of the panel extensions and the adjacent wall of vessel half section 22. The wing sections 64, 66 and panel extensions 60, 62 jointly define the inner wall of the connecting leg of the U-shaped outlet flume. The outer edges of panel sections 54, 56 and wing sections 64, 66 lie in a common plane and respectively contact the sides and bottom walls of the vessel half section 22. Preferably the marginal edge along the sides and bottom of weir member 50 has a rim band section 68 that fits in tight conformity with adjoining wall surface of the vessel half section 22 and extends from the panel and wing sections towards the seam offset or ledge 36 where it terminates in a laterally outwardly extending retaining lip 70 which rests on ledge 36, for example see FIG. 4.

A liquid bleed-through or metering aperture 72 having a diameter of one-sixteenth inch for example, but which may be larger or smaller depending upon the size of the system, is located at the bottom end of weir member 50 in the vertically disposed wing section 64. Preferably the aperture 72 and an area around the aperture are recessed away from the reservoir side of the wing section so that when a screen member 74 is affixed over the recessed area 76, such as by projection welding, a multiplicity of screen openings are available to the recessed area FIG. 5. The screen openings are smaller in size than the metering aperture 72 so they will not allow passage of a particle that is large enough to clog or become lodged in the metering aperture. This vertically screened recess is particularly effective in keeping the metering aperture open and allowing liquid including lubricant oil to flow at a metered rate from the reservoir side to the flume side of the weir.

The top of the outlet leg of the outlet flume is enlarged by forming at the top of weir panel 56 a bulbous section 78 that extends under and slightly beyond the vertically disposed outlet fitting 38 in the top of vessel 20. Preferably this bulbous section 78 is streamlined as much as is possible so that the incoming refrigerant liquid does not splash excessively in a vertical direction either upwardly or downwardly. The top of panel 54 defining the inlet leg of the outlet flume has a narrow lip 80 that extends over an edge of a horizontally disposed baffle plate 82. A vertically projecting twist tab 84 is provided on the top edge of outlet leg panel 56 to locate and hold baffle plate 82 in position on weir member 50 during assembly.

Baffle plate 82 is shaped to conform with the cross sectional shape of the inside of vessel 20 level with the top of weir member 50 but excluding the area over the top of the inlet leg of the flume which is left open. The edge of the baffle 82 along the inlet leg opening fits under weir lip 80. An upturned peripheral rim 86 extends around the remaining edge of baffle 82 and provides a broad surface for sealing the baffle to the vessel wall. A large diameter opening 88 adjacent the center of the baffle plate forms the primary fluid outlet from the reservoir to the flume. Preferably this opening is not centered on the vessel axis but is offset towards the inlet fitting 42 and upstream from the inner end of the fitting 42 so that the entire opening is upstream from this inner end. The area of this primary opening as well as the cross sectional area of the flume passageways are sized so that they are all larger than the area of the vessel inlet or outlet. A second aperture 90 is located between the primary baffle opening and the vessel wall concentrically aligned with the outlet fitting 38. Preferably the inside diameter of aperture 90 is slightly greater than the outside diameter of outlet fitting 38 for ease of assembly but this over-sizing may be made sufficiently greater to provide an annular clearance space to serve as a pressure equalization means inside the vessel. An auxiliary equalization aperture 92 FIG. 2, may also be provided, but the total open area for pressure equalization should not be so large that it amounts to a bypass of the liquid pickup section of the flume. A slot to receive twist tab 84 is also pierced through the baffle plate at an appropriate location. The baffle plate 82 is positioned on top of weir member 50 such that when the baffle-weir assembly is seated in the vessel the inner ends of the vessel inlet and outlet fittings 38, 42 are below the bottom of the plate 82.

When the suction accumulator 15 is connected in a refrigerant compressing—evaporating system line between a compressor and an evaporator, the incoming refrigerant fluid, which may be substantially liquid, substantially gaseous or a mixture of liquid and gas including some lubricating oil, enters the vessel through the tangentially disposed inlet fitting 42 at the top of the reservoir immediately beneath the baffle plate 82. The incoming liquid-gaseous refrigerant mixture is projected against the confronting cylindrical surface of the vessel and caused to flow around the vessel in generally circular or helical path, past the angularly disposed planar weir panels 54, 56 and around the remaining cylindrical section of the vessel. The swirling action of the liquid-gaseous refrigerant creates a vortex in the reservoir and slings the heavier liquid portion of the refrigerant toward the outer wall of the reservoir away from the vicinity of the aperture 88 in baffle 82. The lighter relatively dry refrigerant gas in the vortex area is free to pass out of the reservoir via aperture 88 and enter the upper chamber of the accumulator 15 above baffle 82 with a minimum of restriction or pressure drop. The liquid is temporarily retained in the reservoir as the gaseous portion flows out through the primary reservoir opening 88 then over the top of the weir, down the flume inlet leg, across the connecting leg, past the liquid metering aperture 72, up the flume outlet leg and then vertically out of the vessel through outlet fitting 38. Thus it will be noted that the U-shaped passageway on the flume side of the weir operates as a fluid pickup means i.e., normally gas is drawn into the inlet leg of the passageway and aperture 72 serves as an entrance to the passageway for the metered liquid which flows into the bottom of the passageway out of the reservoir. The velocity of the stream through the connecting leg section is sufficient to pick up and carry the liquid that has passed through the liquid metering aperture 72. Since the compressor lubricant entrained in the liquid or gaseous refrigerant entering the accumulator 15 tends to collect as a liquid in the bottom of the reservoir section of the accumulator 15, the metering aperture 72 in conjunction with the pressure differential existing between the reservoir chamber and the flume chambers induces a metered flow of liquid lubricant into the gaseous refrigerant stream flowing through the flume, thereby insuring that lubricant is continually fed from the accumulator to the compressor. However, the small amount of liquid refrigerant which also may be entrained and metered through the same orifice 72 is insufficient to produce a slugging problem in the compressor even should the same not be evaporated into gaseous form by the time it reaches the suction valve of the compressor.

The process for manufacturing the suction accumulator includes forming the vessel half sections 22, 24 from sheet metal by stamping processes. Inlet and outlet apertures are extrusion pierced in the respective half section to produce collared apertures into which the inlet and outlet fittings 38, 42 are pressed. The weir member 50 and baffle plate 82 are likewise produced from sheet metal by stamping processes. A monel screen 74 is projection welded to the weir member over the recessed section containing the metering aperture 72. The baffle plate 82 is assembled on the weir member 50 by placing its unrimed edge section under the lip 80, inserting the twist tab 84 through its slot and twisting the end of the tab projecting through the plate. The weir-baffle plate sub-assembly is then placed in half section 22 so that its retaining lip 70 rests on ledge 36. Preferably, the parts are then secured by brazing, wherein one or more copper brazing rod segments are placed at appropriate locations and the other half section 24 is positioned so that its seam band 34 is in overlapping relationship with seam band 32 and its leading edge in abutment with weir lip 70. Then the contacting parts of the assembly are brazed together by being placed in a furnace having a hydrogen atmosphere. Additionally a threaded mounting stud 94 may be welded on the bottom end of the vessel.

The suction accumulator 115 shown in FIG. 6–9 is similar in many respects to the previously described embodiment therefore it will not be described in as much detail. Accumulator 115 has a pressure vessel 120 which is particularly suited for systems involving high pressure differentials. Vessel 120 is formed of two generally symmetrical half sections 122, 124 which are joined together by an overlapping seam means to form a pressure vessel having a generally cylindrical midsection 126 and hemispherical ends 128, 130. A horizontally disposed outlet fitting 138 is located on the side of vessel half section 122 and a vertically disposed inlet fitting 142 is located in vessel half section 124. Disposed between these vessel openings and wholly contained in vessel half section 122 is a vertically disposed weir member 150.

The weir member 150 is shaped so that when it is placed in position and attached to the inside wall of the vessel half section 122 it forms a generally U-shaped channel or flume with the confronting wall of the vessel. Variations of the illustrated shape may be used provided a substantially U-shaped flume is produced. Weir member 150 has generally planar wing or panel sections 154, 156 extending outwardly from both sides of a vertically disposed central ridge or rib 158 that is in contact with the inside wall of the vessel and attached thereto. The rib 158 divides the upper portion of the flume into two upright legs but the bottom of the rib terminates short of the bottom of the wing section to provide a fluid passageway or arcuate connecting leg between the bottom ends of the upright legs. Around the edge of the wing sections is an upturned marginal rim 168 which is shaped to conform with the adjacent wall surface of half section 122. Rim 168 is sealingly bonded to this interior wall surface. The top end of the weir member 150 is shaped so that one of the upright legs of the U-shaped flume is closed at the top and the other leg is open at the top to provide the primary fluid communication between the reservoir and the flume. The outlet fitting 138 may be located near the top of the closed end leg a short distance upstream from the closed end to provide a cul-de-sac into which a portion or all of a slug of liquid entering the leg will be projected and temporarily retained rather than being immediately directed out through the opening. The arcuate connecting leg at the bottom of the two upright legs has a greater cross sectional area than either of the upright legs. Each of the legs has a generally triangular cross sectional shape with a side of the triangle on the inside of the fluid flow path adjacent the rib and an angular point on the outside of the flow path.

One or more small metering or liquid bleed-through aperture 172, for example a one-sixteenth inch diameter hole, through the bottom portion of the weir below the rib allows liquid refrigerant and lubricating oil to flow slowly from the reservoir side of the weir member to the flume side thereof. Preferably a screen 174 having smaller openings covers the reservoir side of the recessed apertured area 176 to prevent solid particles from plugging the bleed-through aperture.

Preferably the vessel is equipped with a pressure relief device 180 that is actuated by excessive temperature in the vessel.

Figure 10:
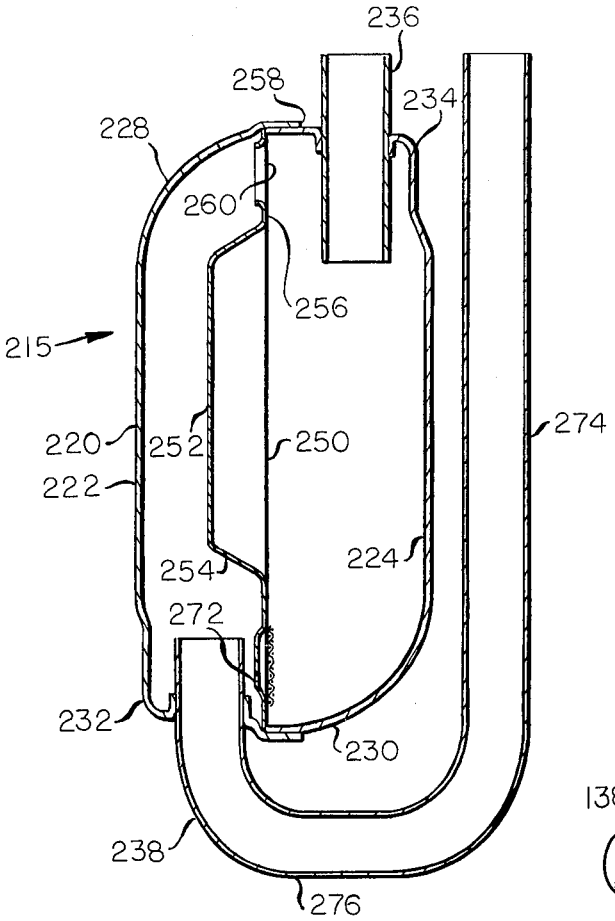
FIG. 10 is a sectional elevation view taken along line 10—10 of FIG. 11 showing a third embodiment of a suction accumulator similar to that of FIGS. 1 and 6 but with one leg of the U-shaped outlet channel being located outside the vessel.
Figure 11:
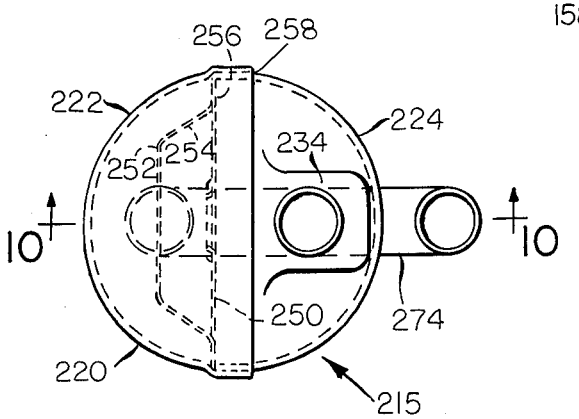
FIG. 11 is a plan view of the suction accumulator of FIG. 10.
Figure 9:
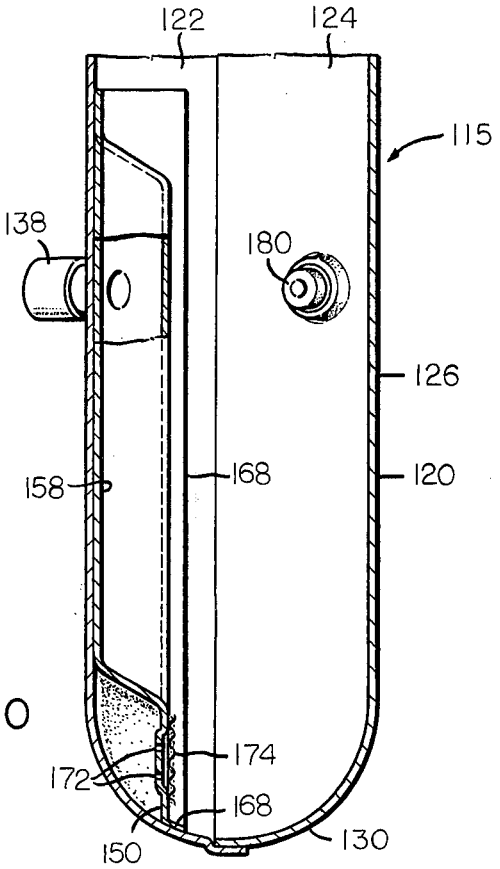
FIG. 9 is a sectional elevation view taken along lines 9—9 of FIG. 6 with a portion of the weir member broken away to show the outlet opening.

The suction accumulator embodiment 215 shown in FIGS. 10 and 11 is similar in many respects to the previously described embodiments. Its vessel 220 is made of two half sections 222, 224 having the same basic shape as the corresponding sections 22 and 24 of the FIG. 1–5 embodiment. The midsection 226 of vessel 220 is relatively shorter and its volume is less than that of vessel 20. Also each of the convex ends 228, 230 of the vessel has an apertured protuberance or nose 232, 234 for receiving an inlet or outlet fitting. An inlet nipple 236 is inserted vertically and sealed in the nose opening in the top of half section 224. The outlet tube 238 is similarly mounted in the nose at the bottom of half section 222.

One primary difference is found in the weir member 250 and the fact that only one vertical leg of the U-shaped channel or flume is contained within the accumulator vessel 220. The weir member 250 is in the form of an oblong shallow pan having a planar central section 252 and an outwardly diverging sidewall 254 which terminates in a relatively wide flat brim 256. The peripheral edge of the brim 256 is locked in place between the half sections at the inside edge of the overlapping seam 258 of the vessel sections. The primary fluid communication opening between the inlet or reservoir side of weir and the outlet or flume side of the weir is a relatively large oblong opening 260 in the top portion of the brim 256. A vertically screened metering aperture 272 is located in the bottom portion of the brim adjacent the vertical centerline of the vessel.

The smaller area between the outlet side of the weir and the confronting vessel wall forms the inside leg of the U-shaped channel or flume. The other upright leg is a tubular member 274 that extends vertically along the outside of the vessel. It may be integrally joined to the lower end of outlet tube 238 by means of an arcuate tube section 276 thus forming the outside portion of the U-shaped channel or flume.

The latter two embodiments are suitable for use in refrigerant compressing—evaporating systems which do not have sudden severe pressure changes across the accumulator.

While the invention has been described and illustrated with respect to three suction accumulator embodiments, it is to be understood that the teachings disclosed herein can be applied to other refrigerant retention devices i.e. devices known as receivers, and that various modifications of the above will be apparent to those skilled in the art without departing from the scope of the invention which is primarily defined by the appended claims.

We claim:

1. A refrigerant retention device comprising a suction accumulator or the like for a refrigerant compressing—evaporating system, said accumulator comprising in combination a pressure vessel, a vertically disposed weir member within said vessel, said vessel having first and second wall sections confronting said weir member on opposite sides of said weir member, said weir member forming a reservoir with said first confronting vessel wall section on one side of said weir member and an outlet flume with said second confronting vessel wall section on the other side of said weir member, a liquid metering aperture through the bottom of said weir member communicating said reservoir with said flume, a fluid inlet to the vessel entering into said reservoir, a fluid outlet from the vessel exiting from said flume, said fluid inlet being disposed generally horizontally and being oriented to direct a stream of fluid into said reservoir tangentially relative to said first confronting vessel wall section at an elevation below the upper end of said weir member and a baffle disposed in said vessel generally horizontally across said reservoir and above the elevation of said fluid inlet to thereby separate said reservoir into a lower, liquid-receiving chamber and an upper gas-accumulating chamber communicating with an inlet to said flume, said baffle having aperture means providing communication between said chambers.

2. The combination as set forth in claim 1 wherein said aperture means comprises an opening in said baffle in generally axial alignment with the center of a vortex area induced in said reservoir by the incoming flow of fluid from said fluid inlet.

3. The combination as set forth in claim 2 wherein said opening is disposed in the shadow of said fluid inlet.

4. The combination as set forth in claim 3 wherein said fluid inlet comprises a tube extending through said first confronting vessel wall section on said one side of said weir member and projecting inwardly therefrom and having an open outlet end directed at an acute angle to an adjacent portion of said first wall section, said opening being offset from the center of said baffle between said outlet end of said tube and the portion of said first wall section through which said tube is received.

5. A suction accumulator as set forth in claim 4 wherein said weir member has a wall portion near the lower end thereof offset from said second wall section on said other side of said weir member, said metering orifice being disposed centrally in said wall portion relative to the side edges of said weir member and communicating with the flume passageway connecting the inlet and outlet flumes defined by said weir member and said second confronting vessel wall section.

6. A suction accumulator as set forth in claim 5 wherein said baffle is joined as a top member to the upper edges of said weir member to form a closure over the outlet flume passageway defined by said weir member and said second confronting vessel wall section, said baffle having an opening portion in registry with the upper end of the inlet flume passageway to form an outlet from said upper gas-accumulating chamber to said inlet flume passageway.

7. A suction accumulator as set forth in claim 6 wherein said baffle member has an aperture therethrough communicating with the outlet flume defined by said weir member and said second confronting wall section for equalizing the pressures between said upper gas-accumulating chamber and the outlet flume passageway.

8. The combination as set forth in claim 2 wherein said fluid inlet comprises a tube extending through said first confronting vessel wall section on said one side of said weir member and projecting inwardly therefrom and having an open outlet end directed at an acute angle to an adjacent portion of said first wall section, said opening being offset from the center of said baffle between said outlet end of said tube and the portion of said first wall section through which said tube is received.

9. A suction accumulator as set forth in claim 1 wherein said weir member has a wall portion near the lower end thereof offset from said second wall section on said other side of said weir member, said metering orifice being disposed centrally in said wall portion relative to the side edges of said weir member and communicating with the flume passageway connecting the inlet and outlet flumes defined by said weir member and said second confronting vessel wall section.

10. A suction accumulator as set forth in claim 1 wherein said baffle is joined as a top member to the upper edges of said weir member to form a closure over the outlet flume passageway defined by said weir member and said second confronting vessel wall section, said baffle having an opening portion in registry with the upper end of the inlet flume passageway to form an outlet from said upper gas-accumulating chamber to said inlet flume passageway.

11. A suction accumulator as set forth in claim 10 wherein said baffle member has an aperture therethrough communicating with the outlet flume defined by said weir member and said second confronting wall section for equalizing the pressures between said upper gas-accumulating chamber and the outlet flume passageway.

* * * * *